US009791795B2

(12) United States Patent
Zhou et al.

(10) Patent No.: US 9,791,795 B2
(45) Date of Patent: Oct. 17, 2017

(54) LOW FIXING TEMPERATURE SUSTAINABLE TONER

(71) Applicant: Xerox Corporation, Norwalk, CT (US)

(72) Inventors: Ke Zhou, Oakville (CA); Guerino G. Sacripante, Oakville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/727,781

(22) Filed: Jun. 1, 2015

(65) Prior Publication Data

US 2016/0349642 A1 Dec. 1, 2016

(51) Int. Cl.
*G03G 9/087* (2006.01)

(52) U.S. Cl.
CPC ..... *G03G 9/08755* (2013.01)

(58) Field of Classification Search
CPC ..... G03G 9/08755
See application file for complete search history.

(56) References Cited

U.S. PATENT DOCUMENTS 8,574,803 B2 * 11/2013 Sacripante ..... G03G 9/081 430/109.4
2012/0276478 A1 * 11/2012 Wosnick ..... G03G 9/08755 430/109.4
2013/0323634 A1 * 12/2013 Sugiura ..... G03G 9/0819 430/105
2015/0111145 A1 4/2015 Sacripante et al.

* cited by examiner

*Primary Examiner* — Hoa V Le
(74) *Attorney, Agent, or Firm* — Marylou J. Lavoie, Esq. LLC

(57) ABSTRACT

The disclosure relates to a resin made with no more than 6 mol % of a rosin or a rosin derivative combined with a lower molecular weight crystalline polyester resin in a toner with low fixing temperature and higher blocking temperature.

20 Claims, No Drawings

LOW FIXING TEMPERATURE SUSTAINABLE TONER

FIELD

Sustainable resins comprising a rosin or a derivative thereof and lower molecular weight crystalline polyester (CPE) resins are combined and used in a toner to achieve resin compatibility resulting in lower fixing temperature and higher blocking temperature.

BACKGROUND

The vast majority of polymeric materials are based on extracting and processing fossil fuels, a limited resource, potentially resulting in accumulation of non-degradable materials in the environment. Recently, the USDA proposed that all toner/ink have a bio-derived (or sustainable) content of at least 20%. Bio-derived resins are being developed but commercial integration of such reagents into toner and ink remains to be resolved. (The terms, "bio-derived resin," "bio-based resin," and, "sustainable resin," are used interchangeably herein and are meant to indicate that the resin or polyester resin is derived from or is obtained from materials or reagents that are obtained from natural sources and are biodegradable, in contrast to materials or monomers obtained from petrochemicals or petroleum-based sources.)

Efforts to utilize crystalline resins with bio-based resins result in blocking issues due to the higher plasticization rate of CPE containing or made of monomers of a higher number of methylene units, such as, using C10:C9 monomers with 10 and 9 methylene units, respectively, in a CPE as compared to using a lower cost CPE derived from C10:C6 monomers (with 10 and 6 methylene units, respectively).

A bio-derived resin along with CPE comprising a lower number of methylene units to produce toner exhibiting good blocking characteristics without plasticization that addresses the problems above is described.

SUMMARY

The instant disclosure describes a process for preparing a sustainable resin using lower cost materials, such as, a rosin-diol, and a CPE comprising smaller monomers with greater resin compatibility resulting in toner with lower fix temperature and higher blocking temperature.

In embodiments, a toner is disclosed including a resin comprising no more than 6 mol % of a rosin or derivative thereof, which resin is the product of reacting a rosin derivative, such as, a rosin-diol and at least one alkylene glycol, and a crystalline polyester (CPE) resin comprising lower molecular weight monomers and optionally one or more components selected from a wax, a colorant, an amorphous resin or combinations thereof, wherein the CPE does not overly plasticize.

In embodiments, the amount of a rosin monomer in a bio-based resin of interest is greater than 5 mol % and no more than 6 mole %.

In embodiments, the resin monomer comprises a rosin-diol, a bis-rosin alcohol, a rosin carbonate and isomers thereof.

A sustainable toner of lower fixing temperature and high blocking temperature is comprised of a bioresin comprising no more than 6 mol % of a rosin or derivative thereof and a CPE comprised of lower molecular weight monomers. The resulting sustainable toner comprises a mean fixing temperature of no more than 125° C. and a blocking temperature of at least about 53° C.

In embodiments, the lower molecular weight CPE comprises acid and alcohol monomers which together contain 16 or fewer methylene groups.

DETAILED DESCRIPTION

Glycerine carbonate ($C_4H_6O_4$) can be reacted with an organic acid, such as, a rosin acid, to make alcohols, such as, rosin-diols (denoted in the FIGURE below as I and II), as well as bis-rosin alcohols (identified as III and IV below) and a rosin-carbonate (identified as V below), as depicted in the following scheme.

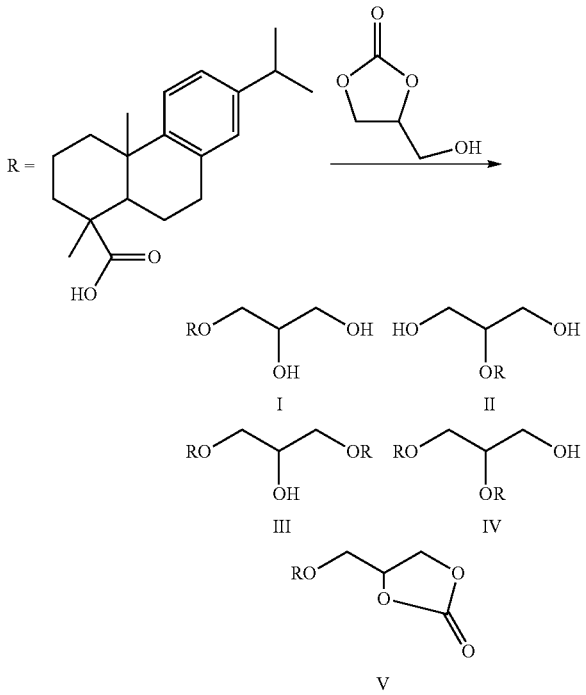

The resulting mixture of rosin adducts I through V can vary in relative amounts depending on, for example, reaction conditions, stoichiometry of the starting rosin acid, glycerine carbonate amount and catalyst. In an embodiment, of from about 1.0 to about 1.2 mole equivalents of rosin acid are reacted with from about 1.2 to about 3 mole equivalents of glycerine carbonate and a catalyst, such as, tetralkyl ammonium halide, at a temperature of from about 140° to about 170° C. The excess glycerine carbonate can be distilled from the reaction mixture, if desired.

The relative ratio of rosin-diol (I and II) amount to bis-rosin alcohol (III and IV) amount can vary of from about 3:1 to about 20:1 when excess glycerine carbonate is utilized as more rosin diol is produced.

Rosin adducts I through V then can be reacted with known polyester-forming monomers, for example, terephthalic acid or succinic acid, and other polyols, such as, butanediol or 1,2-propylene glycol, in a polycondensation reaction to form a resin. Rosin-diols I and II, as well as rosin-carbonate V polymerize with polyacids to form the backbone of a polyester resin, and bis-rosin alcohols III and IV can form terminal groups (moieties) of a polyester resin, as depicted, for example, in the following structure

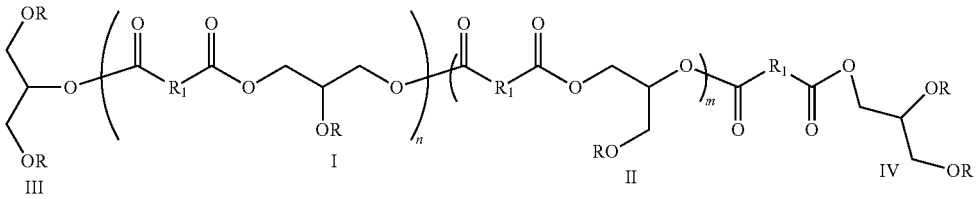

wherein R is a rosin moiety, $R_1$ is an alkyl or aryl moiety, segments I to IV represent the rosin adduct moieties, and n and m represent the number of individual, single acid/alcohol ester units and each of n and m is from about 10 to about 10,000.

The ratio of rosin-diols to bis-rosin alcohols influences polydispersity of a resin. If the ratio of rosin-diols to bis-rosin alcohols is high, such as, from about 10:1, from about 15:1, from about 20:1 or more, polydispersity of the polymer, as measured as the ratio of weight average ($M_w$) to number average ($M_n$) molecular weight, is relatively low, such as, from about 2 to 4. However, if the ratio of rosin-diols to bis-rosin alcohols is lower, such as, from about 6:1, from about 5:1, from about 4:1 or lower, polydispersity of the polymer is relatively high, such as, from 5 to about 40.

To obtain a toner resin with optimal fusing performance, including broad fusing latitude, a toner comprises relative high polydispersity, such as, at least about 5, at least about 7.5, at least about 10, up to about 15, up to about 17.5, up to about 20 or more, which can be obtained with rosin adduct mixtures comprising lower amounts of rosin diols, which can be obtained using lower amounts of, for example, glycerol carbonate when reacted with a rosin acid to form said adducts.

Processes to obtain a lower cost sustainable resin, where rosin adducts for producing resin reagents are made from glycerine carbonate and rosin acid are disclosed. In embodiments, to optimize compatibility of a rosin-based resin with a lower cost crystalline resin comprising smaller acid/ester and alcohol monomers, such as, for example, poly(1,6-hexylene-dodecanoate), CPE 10:6, the amount of rosin-derived monomer in the bioresin is no more than 6 mol % of the bioresin such that compatibility (as revealed, for example, by degree of plasticization) is not too high or too low. To obtain polyester toners with low fixing temperatures and good blocking (cohesion) performance, a mixture of amorphous polyester resins and crystalline polyester resin is at least partially compatible as revealed, for example, by desired toner properties, such as, MFT and blocking performance. If the resulting toner is comprised of an amorphous, biobased polyester resin and a crystalline resin that are too compatible, low fixing temperature is obtained, but that high resin compatibility results in too much plasticization resulting in poor blocking performance. Conversely, if a toner is comprised of an amorphous, biobased polyester resin and a crystalline resin that are not too compatible or incompatible, good blocking performance will be obtained but fixing temperature will be higher. Therefore, to obtain both good blocking and low fixing temperature, an optimal compatibility between the amorphous and crystalline resins is desired.

By good blocking performance, as determined practicing known methods, see, for example, U.S. Pat. No. 7,910,275, herein incorporated by reference in entirety, is a toner with a blocking temperature of at least about 50° C., at least about 53° C., at least about 54° C., at least about 55° C., at least about 56° C. or higher.

By good minimum fixing temperature (MFT), as determined practicing known methods, see, for example, U.S. Pat. No. 7,291,437, herein incorporated by reference in entirety, is a toner with a fixing temperature of no more than about 125° C., no more than about 124° C., no more than about 123° C., no more than about 122° C. or lower.

Fusing (or fixing) latitude is the value obtained when minimum fixing temperature is subtracted from the hot offset temperature, as determined practicing known methods, see, for example, U.S. Pat. No. 7,291,437, herein incorporated by reference in entirety. In a toner of interest, good latitude is at least about 80° C., at least about 82.5° C., at least about 85° C. or higher.

Unless otherwise indicated, all numbers expressing quantities and conditions, and so forth used in the specification and claims are to be understood as being modified in all instances by the term. "about." "About," is meant to indicate a variation of no more than 10% from the stated value. Also used herein is the term, "equivalent," "similar," "essentially," "substantially," "approximating" and "matching," or grammatical variations thereof, have generally acceptable definitions or at the least, are understood to have the same meaning as, "about."

As used herein, a polymer is defined by the monomer(s) from which a polymer is made. Thus, for example, while in a polymer made using terephthalic acid as a monomer reagent, a terephthalic acid moiety per se no longer exists because of the ester condensation reaction, as used herein, that polymer is said to comprise a terephthalic acid. Thus, a biopolymer made by a one-pot process disclosed herein can comprise terephthalate/terephthalic acid; succinic acid; neopentyl glycol and dehydroabietic acid. That biopolymer also can be said to comprise neopentyl glycol as that diol is used with the terephthalate/terephthalic acid and succinic acid; can be said to comprise terephthalic acid as that monomer was used to make the biopolymer; can be said to be composed of or as comprising succinic acid as succinic acid is a monomer reagent of that polymer and so on. Hence, a polymer is defined herein based on one or more of the component monomer reagents, which provides a means to name a polymer of interest and to define and to identify a polymer of interest.

As used herein, "biobased," or use of the prefix, "bio," refers to a reagent or to a product that is composed, in whole or in part, of a biological product, including plant, animal and marine materials, or derivatives thereof. Generally, a biobased or biomaterial is, "biodegradable," that is, substantially or completely biodegradable, by substantially is meant greater than 50%, greater than 60%, greater than 70% or more of the material is degraded from the original molecule to another form by a biological or environmental mechanism, such as, action thereon by bacteria, animals, plants, light, temperature, oxygen and so on in a matter of days, matter of weeks, a year or more, but generally no longer than two years. A, "bioresin," is a resin, such as, a polyester, which contains or is composed of a biobased material in whole or in part, such as, a polyglycol, such as, polyethylene glycol and a dicarboxylic acid. Hence, the reagents can be a biopolyacid and a biopolyol. Such a reagent or resin can be described as, "sustainable," a synonym of bio-based.

In embodiments, a sustainable toner of interest is one which replaces one or more limited, hazardous or petroleum-based reagents with one that is not, one that is sustainable or bio-based. One such less than desired reagent or compound found in commercial toner is bisphenol A (BPA). BPA is considered a possible carcinogen, a compound that could precipitate a number of health issues and one believed to have estrogen activity. Hence, a suitable sustainable toner of interest would be one which replaces some or all BPA-containing reagents with a bio-based reagent, with minimal or no loss of toner performance. Hence, when BPA amount is reduced or removed altogether and replaced with one or more bioreagents, such a sustainable toner is one which is BPA-free, contains no or 0% BPA and other functionally equivalent phrases and terms.

As used herein, "plasticize," including grammatical variations thereof, refers to a change in the thermal and mechanical properties of a given polymer which involves: (a) lowering of rigidity at room temperature (RT); (b) lowering of temperature at which substantial deformations can occur with not too large forces; (c) increase of the elongation to break at RT; and/or (d) increase of toughness (impact strength) down to the lowest temperature of serviceability. For example, a plasticizer lowers $T_g$ of a polymer or negatively impacts blocking (cohesion) of a toner in which a plasticizer is present.

As used herein, a, "rosin," or, "rosin adduct," or grammatic forms thereof is intended to encompass a rosin, a rosin acid, a rosin ester, a rosin-diol, a rosin carbonate, a bis-rosin alcohol and so on, as well as a rosin derivative which is a rosin treated, for example, to comprise plural alcohol groups that can be used directly or indirectly as a monomer in a polyester polymer. Hence, a rosin derivative is a compound that is an acid, ester or alcohol that can be used to form a polyester polymer. As known in the art, rosin is a blend of at least eight monocarboxylic acids. Abietic acid can be a primary species and the other seven acids are isomers thereof. Because of the composition of a rosin, often the synonym, "rosin acid," is used to describe various rosin-derived products. As known, rosin is not a polymer but essentially a varying blend of the eight species of carboxylic acids. A rosin product includes, as known in the art, chemically modified rosin, such as, partially or fully hydrogenated rosin acids, partially or fully dimerized rosin acids, esterified rosin acids, functionalized rosin acids or combinations thereof. Rosin is available commercially in a number of forms, for example, as a rosin acid, as a rosin ester and so on. For example, rosin acids, rosin ester and dimerized rosin are available from Eastman Chemicals under the product lines, POLY-PALE™, DYMEREX™, STAYBELITE-E™, FORAL™ Ax-E, LEWISOL™ and PENTALYN™; Arizona Chemicals under the product lines, SYLVALITE™ and SYLVATAC™; and Arakawa-USA under the product lines, Pensel and Hypal. In embodiments, rosin adducts are compounds I-V depicted hereinabove.

The designation, "CX:CY," "CX:Y," "X:Y," and forms thereof as used herein describe crystalline resins, wherein C is carbon, X is a positive, non-zero integer identifying the number of methylene groups of the acid/ester monomer used to produce the CPE and Y is a positive, non-zero integer identifying the number of methylene groups of the alcohol monomer used to produce the CPE. Thus, for example, C10 can represent, for example, a dodecanedioic acid and C6 can represent, for example, a hexanediol. X and Y each is 10 or lower. In embodiments, the sum of X and Y is 16 or lower.

For example, a rosin acid or polyacidic forms thereof can be reacted with a polyol in a condensation reaction where the hydroxyl group of the alcohol combines at a carboxylic acid group of a rosin acid in a condensation reaction to form a joined molecule, a rosin ester, which is a, "single ester unit," composed of one alcohol monomer joined to one acid/ester monomer, which dimer can be viewed as a "monomer" or subunit when plural copies of that dimer are joined to form a polymer. Additional acid, ester alcohol and/or acid/alcohol monomers are added to the single ester unit to form a polyester polymer. Such a reaction is compatible with one-pot reaction conditions disclosed herein for producing a bioresin.

In embodiments, the reactions as disclosed herein result in, in part, abieticdiol, abietic monoglycerate, palustricdiol, palustric monoglycerate, dehydroabieticdiol, dehydroabietic monoglycerate, neoabieticdiol, neoabietic monoglycerate, levopimaricdiol, levopimaric monoglycerate, pimaricdiol, pimaric monoglycerate, sandaracopimaricdiol, sandaracopimaric monoglycerate, isopimaricdiol, isopimaric monoglycerate, hydrogenated abieticdiol, hydrogenated palustricdiol, hydrogenated dehydroabieticdiol, hydrogenated neoabieticdiol, hydrogenated levopimaricdiol, hydrogenated pimaricdiol, hydrogenated sandaracopimaricdiol, hydrogenated isopimaricdiol and so on.

A catalyst can be included in the reaction mixture to form an ester unit or a polyester polymer. Suitable catalysts include organoamines, such as, ethylamine, butylamine and propylamine, arylamines, such as, imidazole, 2-methyl imidazole, pyridine and dimethylamino pyridine, organoammonium halides, such as, trimethylammonium chloride, triethylammonium chloride, tributylammonium chloride, trimethylammonium bromide, triethylammonium bromide, tributylammonium bromide, trimethylammonium iodide, triethylammonium iodide, tributylammonium iodide, tetraethylammonium chloride, tetraethylammonium bromide and tetraethylammonium iodide, organophosphines, such as, triphenylphosphine, organophosphonium halides, such as, tetraethylphosphonium chloride, tetraethylphosphonium bromide, tetrabutyl phosphonium chloride, tetrabutyl phosphonium bromide, tetrabutyl phosphonium iodide and so on.

The reaction can be conducted at an elevated temperature, such as, from about 130° C. to about 200° C., from about 145° C. to about 175° C., from about 150° C. to about 170° C. and so on, although temperatures outside of those ranges can be used as a design choice.

In embodiments, a bio-based resin of interest comprises rosin or a derivative thereof, for example, one or more of rosin adducts I through V as depicted above, in an amount no more than 6 mol %. In an aspect, 8 mol % or greater of a rosin reagent in a resin results in excessive plasticization (compatibility) of the bio-based resin with a lower molecular weight CPE, resulting, for example, with poor blocking performance. Conversely, 5 mole % or less of rosin reagent results in insufficient plasticization (compatibility) of the rosin-containing bio-based resin when combined with a lower molecular weight CPE, such as, C10:C6. In embodiments, such rosin adducts or derivatives are present in a bioresin in an amount greater than 5 mol % but no more than 6 mol %.

Toner Particles

A toner composition can comprise more than one form or sort of polymer, such as, two or more different polymers, such as, two or more different polyester polymers composed of different monomers, where at least one of the polymers is a rosin-containing biopolymer or bioresin of interest. The polymer can be an alternating copolymer, a block copolymer, a graft copolymer, a branched copolymer, a crosslinked copolymer and so on.

The toner particle can include other optional reagents, such as, a surfactant, a wax, a colorant, a shell and so on. The toner composition optionally can comprise inert particles, which can serve as toner particle carriers, which can comprise a rosin-containing resin taught herein. The inert particles can be modified, for example, the surface thereof can be derivatized or the particles can be manufactured for a desired purpose, for example, to carry a charge or to possess a magnetic field.

A. Components

1. Resin

The biopolyester of interest is used alone with a CPE of interest or in combination with one or more other known resins used in toner with a CPE of interest.

One, two or more polymers in addition to a biopolymer and CPE of interest may be used in forming a toner or toner particle. When additional polymers are used, the polymers may be in any suitable ratio (e.g., weight ratio) such as, for instance, with two different polymers, from about 1% (biopolymer)/99% (second polymer) to about 99% (biopolymer)/1% (second polymer), or outside of those ranges as a design choice. For example, a toner can comprise two forms of amorphous polyester resins, one of which is a biopolymer of interest, and a crystalline resin as taught herein, in relative amounts as a design choice.

a. Polyester Resins

The ratio of crystalline polyester resin to amorphous polyester resins, including a rosin-containing polyester resin of interest, can be in the range from about 1:99 to about 30:70; from about 5:95 to about 25:75; from about 5:95 to about 15:85.

A polyester resin may be obtained synthetically, for example, in an esterification reaction involving a reagent comprising plural acid or ester groups and another reagent comprising alcohol with plural hydroxyl groups, in embodiments, an acid/ester monomer and an alcohol monomer.

In embodiments, the alcohol reagent comprises one or two or more hydroxyl groups, three or more hydroxyl groups. In embodiments, the acid/ester monomer comprises two or more acid or ester groups, three or more acid or ester groups. Reagents comprising three or more functional groups enable, promote or enable and promote polymer branching and crosslinking. Reagents that contain one hydroxyl group can contain a reactive ester group or can promote resin end capping.

Examples of polyacids or polyesters, which may be a bioacid or a bioester, that can be used for preparing an amorphous polyester resin include terephthalic acid, phthalic acid, isophthalic acid, fumaric acid, trimellitic acid, diethyl fumarate, dimethyl itaconate, cis-1,4-diacetoxy-2-butene, dimethyl fumarate, diethyl maleate, maleic acid, succinic acid, itaconic acid, succinic acid, cyclohexanoic acid, succinic anhydride, dodecylsuccinic acid, dodecylsuccinic anhydride, glutaric acid, glutaric anhydride, adipic acid, pimelic acid, suberic acid, azelaic acid, dodecanedioic acid, dimethyl naphthalenedicarboxylate, dimethyl terephthalate, diethyl terephthalate, dimethylisophthalate, diethylisophthalate, dimethylphthalate, phthalic anhydride, diethylphthalate, dimethylsuccinate, naphthalene dicarboxylic acid, dimer diacid, dimethylfumarate, dimethylmaleate, dimethylglutarate, dimethyladipate, dimethyl dodecylsuccinate, and combinations thereof. The polyacid or polyester reagent may be present, for example, in an amount from about 40 to about 60 mol % of the resin, irrespective of the number of species of acid or ester monomers used.

Examples of polyols which may be used in generating an amorphous polyester resin include rosin-diols, bis-rosin alcohols, 1,2-propanediol, 1,3-propanediol, 1,2-butanediol, 1,3-butanediol 1,4-butanediol, pentanediol, hexanediol, 2,2-dimethylpropanediol, 2,2,3-trimethylhexanediol, dodecanediol, 1,4-cyclohexanedimethanol, 1,3-cyclohexanedimethanol, heptanediol, xylenedimethanol, cyclohexanediol, diethylene glycol, bis(2-hydroxyethyl) oxide, dipropylene glycol, dibutylene glycol and combinations thereof. The amount of polyol can vary, and may be present, for example, in an amount from about 40 to about 60 mol % of the resin.

For forming a crystalline polyester resin, suitable polyols include aliphatic polyols with from about 2 to about 12 carbon atoms, with no more than 10 methylene groups, such as, 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like. The polyol may be, for example, selected in an amount from about 40 to about 60 mol %.

Examples of polyacid or polyester reagents for preparing a crystalline resin include reagents of from about 2 to about 12 carbon atoms, with no more than 10 methylene groups, such as, oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, 1,10 decanedioic acid, 1,11-undecanedioic acid, 1,9-nonanedioic acid, 1,12-dodecanedioic acid, terephthalic acid, naphthalene-2,6-dicarboxylic acid, naphthalene-2,7-dicarboxylic acid, cyclohexane dicarboxylic acid (sometimes referred to herein, in embodiments, as cyclohexanedioic acid), malonic acid and mesaconic acid, a polyester or anhydride thereof. The polyacid may be selected in an amount of, for example, in embodiments, from about 40 to about 60 mol %.

Specific crystalline resins that can be used include poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(1,6-hexylene-decanoate), poly(1,6-hexylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate) and copoly(2,2-dimethylpropane-1,3-diol-decanoate)-copoly(ethylene-adipate).

A suitable CPE resin may include a resin of 1,12-dodecanedioic acid and 1,6-hexanediol monomers, where such CPE resin is denoted a C10:6, where the integers represent the number of methylene units (e.g., C10, ten methylene units and C6, six methylene units) in the reagents, single ester unit and polyester polymer.

A suitable CPE is one which has as a basic ester unit, composed of an alcohol monomer and an acid/ester monomer joined by an ester condensation reaction to form a dimer, where said dimer is repeated in a polyester polymer, where the dimer can be viewed as a monomer of the polymer, the unit having the following structure:

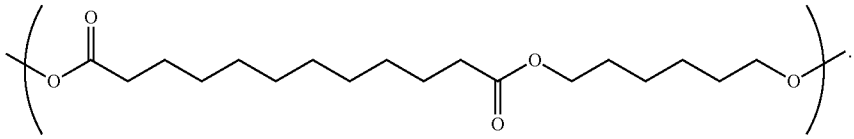

The crystalline resin may be present, for example, in an amount from about 1 to about 25% by weight of the toner components, from about 2 to about 20% by weight of the toner components, from about 3 to about 15% by weight of the toner components. The crystalline resin can possess various melting points of, for example, from about 30° C. to about 120° C., from about 50° C. to about 90° C., from about 60° C. to about 80° C. The crystalline resin may have a number average molecular weight ($M_n$), as measured by gel permeation chromatography (GPC) of, for example, from about 1,000 to about 50,000, from about 2,000 to about 25,000, and a weight average molecular weight ($M_w$) of, for example, from about 2,000 to about 100,000, from about 3,000 to about 80,000, as determined by GPC. The molecular weight distribution ($M_w/M_n$ or polydispersity) of the crystalline resin may be, for example, from 5 to about 40, from about 6 to about 35, or outside of those ranges and at least greater than 5.

b. Esterification Catalyst

Condensation catalysts may be used in a polyester reaction and include those disclosed hereinabove, and tetraalkyl titanates; dialkyltin oxides, such as, dibutyltin oxide; tetraalkyltins, such as, dibutyltin dilaurate; dibutyltin diacetate; dibutyltin oxide; dialkyltin oxide hydroxides, such as, butyltin oxide hydroxide; aluminum alkoxides, alkyl zinc, dialkyl zinc, zinc oxide, stannous oxide, stannous chloride, butylstannoic acid or combinations thereof.

Such catalysts may be used in amounts of, for example, from about 0.01 mole % to about 5 mole % based on the amount of starting polyacid, polyol or polyester reagent in the reaction mixture.

c. Branching/Crosslinking

Branching agents can be used and include, for example, a multivalent polyacid, such as, 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, 1,2,7,8-octanetetracarboxylic acid, acid anhydrides thereof, lower alkyl esters thereof and multivalent polyols, such as, glycerine, pentaerythritol, glycerine carbonate, trimethylopropane and so on. A branching agent can be used in an amount from about 0.01 to about 10 mole % of the resin, although amounts outside of that range can be used.

d. Process

Hence, suitable polyacids/polyesters and polyols, which may be biodegradable, are combined under suitable conditions, as known in the art, such as, mixed at RT, generally, from about 20° C. to about 25° C., and then heated to an elevated temperature, under atmospheric or inert gas conditions, under reduced or elevated pressure as known in the art and so on, as a design choice. The esterification reaction generally produces water or an alcohol byproduct, which can be removed practicing known materials and methods, such as, distillation.

For example, as known in the art, the polyacid/polyester and polyol reagents, including dipropylene glycol, are mixed together, optionally with a catalyst, and incubated at an elevated temperature, such as, from about 200° C. or more, from about 210° C. or more, from about 220° C. or more, and so on, but sometimes not more than about 230° C., not more than about 235° C. or more, although temperatures outside of those ranges can be used to enable esterification to proceed to equilibrium, which generally yields water or an alcohol as a byproduct, such as, methanol, arising from forming the ester bonds in esterification reactions. Temperatures above 230° C. may result in volatilization of some reagents, for example, dipropylene glycol, and removal of that reagent can moderate a condensation reaction, and hence, the acid value (AV) of the developing polymer. The reaction can be conducted under vacuum to promote polymerization and to facilitate removal of any volatilized reagents. The reaction can be conducted under an inert atmosphere, such as, nitrogen gas, again, which can facilitate removal of any volatilized reagents.

To provide latitude in manipulating reaction conditions to obtain resins with the desired softening temperature ($T_g$) and AV, a stoichiometric imbalance of polyacid to polyol can be utilized, and generally, the polyacid is in excess unless the polyol is volatile and distills from the mixture. An excess of a reagent can be determined in terms of stoichiometric excess of alcohol to acid in the reaction mixture. That can be assessed in terms of molar equivalents such that the molar ratio of alcohol:acid is greater than 0.5:0.5, for example, from about 0.505 to about 0.495, from about 0.51 to about 0.49, from about 0.515 to about 0.485, from about 0.52 to about 0.48 or greater amounts of alcohol relative to acid. When another alcohol is included in the reaction, the molar equivalents of the alcohols are summed for the above calculation.

Accordingly, disclosed herein is one-pot reaction for producing a biopolyester resin suitable for use in an imaging toner. A biopolyester resin is produced and processed to form a polymer reagent, which can be dried and formed into flowable particles, such as, a pellet, a powder and the like. The polymer reagent then can be incorporated with, for example, other reagents suitable for making a toner particle, such as, a colorant and/or a wax, and processed in a known manner to produce toner particles.

Polyester resins suitable for use in an imaging device can carry one or more properties, such as, a glass transition temperature ($T_g$)(onset) of at least about 50° C., at least about 53° C., at least about 55° C.; a $T_g$ of at least about 110° C., at least about 120° C., at least about 125° C.; an AV of at least about 8, at least about 12 mg of KOH/g, at least about 15 mg of KOH/g, or an AV from about 8 to about 18 mg of KOH/g, from about from about 11 to about 17 mg of KOH/g, from about 10 to about 16 mg of KOH/g; an $M_W$ of at least about 10,000 g/mol, at least about 25,000 g/mol, at least about 60,000 g/mol; and an Mn of at least about 50,000 g/mol, at least about 10,000 g/mol, at least about 15,000 g/mol.

2. Colorants

Suitable colorants include a carbon black, such as, REGAL 330® and Nipex 35; magnetites, such as, Mobay magnetites, MO8029™ and MO8060™; Columbian magnetites, MAPICO® BLACK; surface-treated magnetites; Pfizer magnetites, CB4799™, CB5300™, CB5600™ and MCX6369™; Bayer magnetites, BAYFERROX 8600™ and 8610™; Northern Pigments magnetites, NP-604™ and NP-608™; Magnox magnetites, TMB-100™ or TMB-104™; and the like.

Colorants, such as, cyan, magenta, yellow, red, orange, green, brown, blue or mixtures thereof can be used. Colorants can be used as water-based pigments.

Examples of other colorants include SUNSPERSE 6000, FLEXIVERSE and AQUATONE, water-based pigment dispersions from SUN Chemicals; HELIOGEN BLUE L6900™, D6840™, D7080™, D7020™, PYLAM OIL BLUE™, PYLAM OIL YELLOW™ and PIGMENT BLUE 1™ available from Paul Uhlich & Company, Inc.; PIGMENT VIOLET I™, PIGMENT RED 48™, LEMON CHROME YELLOW DCC IO26™, TOLUIDINE RED™ and BON RED C™ available from Dominion Color Corporation, Ltd., Toronto, Ontario; NOVAPERM YELLOW FGL™ from Hoechst; CINQUASIA MAGENTA™ available from E.I. DuPont de Nemours & Co., and the like.

Examples of magenta colorants include 2,9-dimethyl-substituted quinacridone, an anthraquinone dye identified in the Color Index as CI 60710, CI Dispersed Red 15, a diazo dye identified in the Color Index as CI 26050, CI Solvent Red 19 and the like.

Illustrative examples of cyan colorants include copper tetra(octadecylsulfonamido) phthalocyanine, a copper phthalocyanine pigment listed in the Color Index as CI 74160, CI Pigment Blue, Pigment Blue 15:3, Pigment Blue 15:4, an Anthrazine Blue identified in the Color Index as CI 69810, Special Blue X-2137 and the like.

Illustrative examples of yellow colorants are diarylide yellow 3,3-dichlorobenzidene acetoacetanilide, a monoazo pigment identified in the Color Index as CI 12700, CI Solvent Yellow 16, a nitrophenyl amine sulfonamide identified in the Color Index as Foron Yellow SE/GLN, CI Disperse Yellow 3 and 2,5-dimethoxy-4-sulfonanilide phenylazo-4'-chloro-2,5-dimethoxy acetoacetanilide.

Other known colorants can be used, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF). PV Fast Blue B2G 01 (American Hoechst), Sunsperse Blue BHD 6000 (Sun Chemicals), Irgalite Blue BCA (CibaGeigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF). Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), SUCD-Yellow D01355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like. Other colorants that can be used, and which are commercially available include various colorants in the color classes, Pigment Yellow 74, Pigment Yellow 14, Pigment Yellow 83, Pigment Orange 34, Pigment Red 238, Pigment Red 122, Pigment Red 48:1, Pigment Red 269, Pigment Red 53:1, Pigment Red 57:1, Pigment Red 83:1, Pigment Violet 23, Pigment Green 7 and so on, and combinations thereof.

In general, colorant may be employed in an amount ranging from 0% (colorless or clear) to about 35% by weight of the toner particles on a solids basis.

3. Optional Components a. Surfactants

Toner compositions or reagents therefor may be in dispersions or emulsions including a surfactant. Emulsion aggregation (EA) methods where the polymer and other components of the toner are in combination or are in an aqueous or organic medium can employ one or more surfactants to form an emulsion.

One, two or more surfactants may be used. The surfactants may be selected from ionic surfactants and nonionic surfactants, or combinations thereof. Anionic surfactants and cationic surfactants are encompassed by the term, "ionic surfactants."

In embodiments, the surfactant or the total amount of surfactants may be used in an amount of from about 0.01% to about 5% by weight of the reagents in a composition.

Examples of nonionic surfactants include, for example, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether and dialkylphenoxy poly(ethyleneoxy) ethanol, for example, available from Rhone-Poulenc as IGEPAL CA-210™, IGEPAL CA-520™, IGEPAL CA-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC® PR/F, in embodiments, SYNPERONIC® PR/F 108; and a DOWFAX, available from The Dow Chemical Corp.

Anionic surfactants include sulfates and sulfonates, such as, sodium dodecylsulfate (SDS), sodium dodecylbenzene sulfonate, sodium dodecylnaphthalene sulfate and so on; dialkyl benzenealkyl sulfates; acids, such as, palmitic acid, and NEOGEN or NEOGEN SC obtained from Daiichi Kogyo Seiyaku, and so on, combinations thereof and the like. Other suitable anionic surfactants include, in embodiments, alkyldiphenyloxide disulfonates or TAYCA POWER BN2060 from Tayca Corporation (Japan), which is a branched sodium dodecyl benzene sulfonate. Combinations of those surfactants and any of the foregoing nonionic surfactants may be used in embodiments.

Examples of cationic surfactants include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, trimethyl ammonium bromides, halide salts of quarternized polyoxyethylalkylamines, dodecylbenzyl triethyl ammonium chlorides, MIRAPOL® and ALKAQUAT® available from Alkaril Chemical Company, SANISOL® (benzalkonium chloride) available from Kao Chemicals and the like, and mixtures thereof, including, for example, a nonionic surfactant as known in the art or provided hereinabove.

b. Waxes

The toners of the instant disclosure, optionally, may contain a wax, which can be either a single type of wax or a mixture of two or more different types of waxes (hereinafter identified as, "a wax"). When included, the wax may be present in an amount of, for example, from about 1 wt % to about 25 wt % of the toner particles. Waxes that may be selected include waxes having, for example, an $M_w$ of from about 500 to about 20,000.

Waxes that may be used include, for example, polyolefins, such as, polyethylene, polypropylene and polybutene waxes, such as, those that are commercially available, for example, POLYWAX™ polyethylene waxes from Baker Petrolite, wax emulsions available from Michaelman, Inc. or Daniels Products Co., EPOLENE N15™ which is commercially available from Eastman Chemical Products, Inc., VISCOL 550-P™, a low weight average molecular weight polypropylene available from Sanyo Kasei K. K.; plant-based waxes, such as carnauba wax, rice wax, candelilla wax, sumac wax and jojoba oil; animal-based waxes, such as beeswax; mineral-based waxes and petroleum-based waxes, such as montan wax, ozokerite, ceresin wax, paraffin wax, microcrystalline wax and Fischer-Tropsch waxes; ester waxes obtained from higher fatty acids and higher alcohols, such as stearyl stearate and behenyl behenate; ester waxes obtained from higher fatty acids and monovalent or multivalent lower alcohols, such as butyl stearate, propyl oleate, glyceride monostearate, glyceride distearate and pentaerythritol tetrabehenate; ester waxes obtained from higher fatty acids and multivalent alcohol multimers, such as diethyleneglycol monostearate, dipropyleneglycol distearate, diglyceryl distearate and triglyceryl tetrastearate; sorbitan higher fatty acid ester waxes, such as sorbitan monostearate; cholesterol higher fatty acid ester waxes, such as, cholesteryl stearate, and so on.

Examples of functionalized waxes that may be used include, for example, amines and amides, for example, AQUA SUPERSLIP 6550™ and SUPERSLIP 6530™ available from Micro Powder Inc.; fluorinated waxes, for example, POLYFLUO 190™, POLYFLUO 200™, POLYSILK 19™ and POLYSILK 14™ available from Micro Powder Inc.; mixed fluorinated amide waxes, for example, MICROSPERSION 19™ also available from Micro Powder Inc.; imides, esters, quaternary amines, carboxylic acids, acrylic polymer emulsions, for example, JONCRYL 74™, 89™, 130™, 537™ and 538™ available from SC Johnson Wax; and chlorinated polypropylenes and polyethylenes available from Allied Chemical, Petrolite Corp. and SC Johnson. Mixtures and combinations of the foregoing waxes also may be used in embodiments.

c. Aggregating Factor

An aggregating factor (or coagulant) may be used to facilitate growth of the nascent toner particles and may be an inorganic cationic coagulant, such as, for example, polyaluminum chloride (PAC), polyaluminum sulfosilicate (PASS), aluminum sulfate, zinc sulfate, magnesium sulfate, chlorides of magnesium, calcium, zinc, beryllium, aluminum, sodium, other metal halides including monovalent and divalent halides and so on.

The aggregating factor may be present in an emulsion in an amount of from, for example, from about 0 to about 10 wt %, from about 0.05 to about 5 wt % based on the total solids in the toner.

d. Surface Additive

The toner particles can be mixed with one or more of silicon dioxide or silica ($SiO_2$), titania or titanium dioxide ($TiO_2$) and/or cerium oxide, among other additives. Silica may be a first silica and a second silica. The second silica may have a larger average size (diameter) than the first silica. The first silica may have an average primary particle size, measured in diameter, in the range of from about 5 nm to about 50 nm. The second silica may have an average primary particle size, measured in diameter, in the range of from about 100 nm to about 200 nm. The titania may have an average primary particle size in the range of from about 5 nm to about 50 nm. The cerium oxide may have an average primary particle size in the range of, for example, about 5 nm to about 50 nm.

Zinc stearate also may be used as an external additive. Calcium stearate and magnesium stearate may provide similar functions. Zinc stearate may have an average primary particle size of from about 500 nm to about 700 nm.

B. Toner Particle Preparation

The toner particles may be prepared by any method within the purview of one skilled in the art, for example, any of the EA methods can be used with a polyester resin. However, any suitable method of preparing toner particles may be used, including chemical processes, such as, suspension and encapsulation processes disclosed, for example, in U.S. Pat. Nos. 5,290,654 and 5,302,486, the disclosure of each of which herein is incorporated by reference in entirety; by conventional granulation methods, such as, jet milling; pelletizing slabs of material; other mechanical processes; any process for producing nanoparticles or microparticles; and so on.

In embodiments relating to an EA process, a resin, for example, made as described above, can be dissolved in a solvent, and can be mixed into an emulsion medium, for example water, such as, deionized water (DIW), optionally containing a stabilizer, and optionally a surfactant. Examples of suitable stabilizers include water-soluble alkali metal hydroxides, such as, sodium hydroxide, potassium hydroxide, lithium hydroxide, beryllium hydroxide, magnesium hydroxide, calcium hydroxide or barium hydroxide; ammonium hydroxide; alkali metal carbonates, such as, sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. When a stabilizer is used, the stabilizer can be present in amounts of from about 0.1% to about 5% by weight of the resin. The stabilizer can be added to the mixture at ambient temperature or can be heated to the mixture temperature prior to addition.

Following emulsification, toner compositions may be prepared by aggregating a mixture of a resin, an optional colorant, an optional wax and any other desired additives in an emulsion, optionally, with surfactants as described above, and then optionally coalescing the aggregated particles in the mixture. A mixture may be prepared by adding an optional wax or other materials, which optionally also may be in a dispersion, including a surfactant, to the emulsion comprising a resin-forming material or a resin. The pH of the resulting mixture may be adjusted with an acid, such as, for example, acetic acid, nitric acid or the like. In embodiments, the pH of the mixture may be adjusted to from about 2 to about 4.5.

Additionally, in embodiments, the mixture may be homogenized at a speed from about 600 to about 4,000 rpm. Homogenization may be by any suitable means, including, for example, an IKA ULTRA TURRAX T50 probe homogenizer.

Following preparation of the above mixture, larger particles or aggregates, often sized in micrometers, formed from the smaller resin particles, for example, from the initial polymerization reaction, often sized in nanometers, are obtained. An aggregating agent may be added to the mixture to facilitate the process. Suitable aggregating factors or agents include, for example, aqueous solutions of a divalent cation, a multivalent cation or a compound comprising same.

The aggregating factor may be added to the mixture at a temperature that is below the $T_g$ of the resin or of a polymer.

The aggregating factor may be added to the mixture components to form a toner in an amount of, for example, from about 0.1 part per hundred (pph) to about 1 pph.

To control aggregation of the particles, the aggregating factor may be metered into the mixture over time. For example, the factor may be added incrementally into the mixture over a period of from about 5 to about 240 minutes.

Addition of the aggregating factor also may be done while the mixture is maintained under stirred conditions, in embodiments, from about 50 rpm to about 1,000 rpm; and at a temperature that is below the $T_g$ of the resin or polymer. Growth and shaping of particles following addition of aggregation factor may be accomplished under any suitable condition(s).

Particles may be permitted to aggregate until a predetermined desired particle size is attained. Particle size can be monitored during the growth process, for example, with a COULTER COUNTER, for average particle size. Aggregation thus may proceed by maintaining the mixture, for example, at elevated temperature, or slowly raising the temperature, for example, from about 40° C. to about 100° C., and holding the mixture at that temperature from about 0.5 hr to about 6 hrs, while maintaining stirring, to provide the desired aggregated particles. Once the predetermined desired particle size is attained, growth is halted.

Once the desired size of the toner particles or aggregates is achieved, the pH of the mixture may be adjusted with base or buffer to a value of from about 5 to about 10. The adjustment of pH may be used to freeze, that is, to stop, toner particle growth. The base used to stop toner particle growth may be, for example, an alkali metal hydroxide, such as, sodium hydroxide, potassium hydroxide, ammonium hydroxide, and the like, and combinations thereof.

In embodiments, an agent may be introduced after aggregation is complete to contribute to pH adjustment. Thus, the agent used after aggregation is complete may comprise, for example, ethylenediamine tetraacetic acid (EDTA), gluconal, hydroxyl-2,2'iminodisuccinic acid (HIDS), dicarboxylmethyl glutamic acid (GLDA), methyl glycidyl diacetic acid (MGDA), hydroxydiethyliminodiacetic acid (HIDA), sodium gluconate, potassium citrate, sodium citrate, nitrotriacetate salt, humic acid, fulvic acid; salts of EDTA, such as, alkali metal salts of EDTA, tartaric acid, gluconic acid, oxalic acid, polyacrylates, sugar acrylates, citric acid, polyaspartic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, thiamine pyrophosphate, farnesyl pyrophosphate, 2-aminoethylpyrophosphate, hydroxyl ethylidene-1,1-diphosphonic acid, aminotrimethylenephosphonic acid, diethylene triaminepentamethylene phosphonic acid, ethylenediamine tetramethylene phosphonic acid and mixtures thereof.

The aggregates particles may be of a size of less than about 8 μm, from about 2 μm to about 7 μm, but sizes outside of those ranges can be used.

After aggregation, but prior to coalescence, a resin coating may be applied to the aggregated particles to form a shell thereover. A shell can comprise any resin described herein, such as, a rosin resin of interest, or as known in the art. In embodiments, a polyester amorphous resin latex as described herein may be included in a shell, which may be combined with a different resin, and then added to the particles as a resin coating to form a shell.

A shell resin may be applied to the aggregated particles by any method within the purview of those skilled in the art. A resin emulsion may be combined with the aggregated particles so that a shell forms over the aggregated particles.

Formation of a shell over aggregated particles may occur while heating to a temperature from about 30° C. to about 80° C. Formation of a shell may take place for a period of time from about 5 minutes to about 10 hours.

A shell may be present in an amount from about 1% by weight to about 80% by weight of the toner particle.

Following aggregation to a desired particle size and application of any optional shell, the particles then may be coalesced to a desired final shape, such as, a circular shape, for example, to correct for irregularities in shape and size. Coalescence can be achieved by, for example, heating the mixture to a temperature from about 45° C. to about 100° C., which may be at or above the $T_g$ of the resins used to form the toner particles, and/or reducing the stirring, for example, from about 1000 to about 100 rpm. Coalescence may be conducted over a period from about 0.01 to about 9 hr, see, for example, U.S. Pat. No. 7,736,831.

Optionally, a coalescing agent can be used. Examples of suitable coalescence agents include, but are not limited to, benzoic acid alkyl esters, ester alcohols, glycol/ether-type solvents, long chain aliphatic alcohols, aromatic alcohols, mixtures thereof and the like.

The coalescence agent (or coalescing or coalescence aid agent) can evaporate during later stages of the EA process, such as, during a second heating step, that is, generally above the $T_g$ of the resin or a polymer. The final toner particles are thus, free of, or essentially or substantially free of any remaining coalescence agent. To the extent that any remaining coalescence agent may be present in a final toner particle, the amount of remaining coalescence agent is such that presence thereof does not affect any properties or the performance of the toner or developer.

The coalescence agent can be added prior to the coalescence or fusing step in any desired or suitable amount. For example, the coalescence agent can be added in an amount of from about 0.01 to about 10% by weight, based on the solids content in the reaction medium. Amounts outside that range can be used, as desired.

After coalescence, the mixture may be cooled to RT, such as, from about 20° C. to about 25° C. Cooling may be rapid or slow, as desired. A suitable cooling method may include introducing cold water in a jacket around a reactor. After cooling, the toner particles optionally may be washed with water and then dried. Drying may be accomplished by any suitable method for drying including, for example, freeze drying.

The toner particles also may contain optional additives.

The toner may include any known charge additives in amounts of from about 0.1 to about 10 weight % of the toner. Examples of such charge additives include alkyl pyridinium halides, bisulfates, the charge control additives of U.S. Pat. Nos. 3,944,493; 4,007,293; 4,079,014; 4,394,430; and 4,560,635, the disclosure of each of which herein is incorporated by reference in entirety, negative charge enhancing additives, such as, aluminum complexes, and the like.

Charge enhancing molecules can be used to impart either a positive or a negative charge on a toner particle. Examples include quaternary ammonium compounds, see, for example, U.S. Pat. No. 4,298,672, organic sulfate and sulfonate compounds, see for example, U.S. Pat. No. 4,338,390, cetyl pyridinium tetrafluoroborates, distearyl dimethyl ammonium methyl sulfate, aluminum salts and so on.

Surface additives can be added to the toner compositions, for example, after washing or drying. Examples of such surface additives include, for example, one or more of a metal salt, a metal salt of a fatty acid, a colloidal silica, a metal oxide, such as, $TiO_2$ (for example, for improved relative humidity (RH) stability, tribo control and improved development and transfer stability), an aluminum oxide, a cerium oxide, a strontium titanate, $SiO_2$, mixtures thereof and the like. Examples of such additives include those disclosed in U.S. Pat. Nos. 3,590,000; 3,720,617; 3,655,374; and 3,983,045, the disclosure of each of which herein is incorporated by reference in entirety.

Additives may be in an amount of from about 0.1 to about 10 wt % of the toner particle.

Other surface additives include lubricants, such as, a metal salt of a fatty acid (e.g., zinc or calcium stearate) or long chain alcohols, such as, UNILIN 700 available from Baker Petrolite and AEROSIL R972® available from Degussa. Coated silicas of U.S. Pat. Nos. 6,190,815 and 6,004,714, the disclosure of each of which herein is incorporated by reference in entirety, also can be present. An additive can be in an amount of from about 0.05 to about 5% by weight of the toner particle, which additives can be added during aggregation or blended into a formed toner product.

Toners may possess suitable charge characteristics when exposed to extreme RH conditions. The low humidity zone (C zone) may be about 10° C. and 15% RH, while the high humidity zone (A zone) may be about 28° C. and 85% RH.

Toners of the instant disclosure also may possess a parent toner charge per mass ratio (q/m) of from about −5 μC/g to about −90 μC/g, and a final toner charge after surface additive blending of from about −15 μC/g to about −80 μC/g.

Gloss of a toner may be influenced by amount of retained metal ion, such as, $Al^{3+}$, in a particle. Amount of retained metal ion may be adjusted by addition of a chelator, such as, EDTA. Amount of retained metal ion, for example, $Al^{3+}$, in toner particles of the present disclosure may be from about 0.001 pph to about 1 pph. The gloss level of a toner of the instant disclosure may have a gloss, as measured by Gardner device, of from about 20 gloss units (gu) to about 100 gu.

Other desirable characteristics of a toner include storage stability, particle size integrity, high rate of fusing to the substrate or receiving member, sufficient release of the image from the photoreceptor, nondocument offset, use of smaller-sized particles and so on, and such characteristics can be obtained by including suitable reagents, suitable additives or both, and/or preparing the toner with particular protocols.

The characteristics of the toner particles may be determined by any suitable technique and apparatus. Volume average particle diameter and geometric standard deviation may be measured using an instrument, such as, a Beckman Coulter MULTISIZER 3, operated in accordance with the instructions of the manufacturer.

Dry toner particles, exclusive of external additives, may have the following characteristics: (1) volume average diameter (also referred to as "volume average particle diameter") of from about 2.5 to about 20 μm; (2) number average geometric standard deviation ($GSD_n$) and/or volume average geometric standard deviation ($GSD_v$) of from about 1.18 to about 1.30; and (3) circularity of from about 0.9 to about 1.0 (measured with, for example, a Sysmex FPIA 2100 analyzer).

Developers

The toner particles thus formed may be formulated into a developer composition. For example, the toner particles may be mixed with carrier particles to achieve a two component developer composition. The toner concentration in the developer may be from about 1% to about 25% by weight of the total weight of the developer, with the remainder of the developer composition being the carrier. However, different toner and carrier percentages may be used to achieve a developer composition with desired characteristics.

1. Carrier

Examples of carrier particles for mixing with the toner particles include those particles that are capable of triboelectrically obtaining a charge of polarity opposite to that of the toner panicles. Illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326.

The carrier particles may include a core with a coating thereover, which may be formed from a polymer or a mixture of polymers that are not in close proximity thereto in the triboelectric series, such as, those as taught herein or as known in the art. The coating may include fluoropolymers. The coating may have a coating weight of, for example, from about 0.1 to about 5% by weight of the carrier.

Various effective suitable means can be used to apply a polymer to the surface of the carrier core, for example, cascade roll mixing, tumbling, milling, shaking, electrostatic powder cloud spraying, fluidized bed mixing, electrostatic disc processing, electrostatic curtain processing, combinations thereof and the like. The mixture of carrier core particles and polymer then may be heated to enable the polymer to melt or to fuse to the carrier core. The coated carrier particles then may be cooled and thereafter classified to a desired particle size.

Devices Comprising a Toner Particle

Toners and developers can be combined with a number of devices ranging from enclosures or vessels, such as, a vial, a bottle, a flexible container, such as a bag or a package, and so on, to devices that serve more than a storage function, such as, a toner delivery device, such as, a cartridge, for forming an image. Blocking performance can be manifest as storage stability as a finely divided powder.

Imaging or Forming Devices

The toners or developers can be used for electrostatographic or electrophotographic processes, including those disclosed in U.S. Pat. No. 4,295,990, the disclosure of which herein is incorporated by reference in entirety. Any known type of image development system may be used in an image developing device, including, for example, magnetic brush development, jumping single component development, hybrid scavengeless development (HSD) and the like. Those and similar development systems are within the purview of those skilled in the art.

Imaging processes include, for example, preparing an image with an electrophotographic device including, for example, one or more of a charging component, an imaging component, a photoconductive component, a developing component, a transfer component, a fusing component and so on. The device may include a high speed printer, a color printer and the like.

Once the image is formed with toners/developers via a suitable image development method, such as any of the aforementioned methods, the image then may be transferred to an image receiving medium or substrate, such as, a paper and the like. In embodiments, the fusing member or component, which can be of any desired or suitable configuration, such as, a drum, a roller, a belt, a web, a flat surface, a platen or the like, may be used to set the toner image on the substrate. MFT is a consideration as the minimum temperature needed to affix images comprising toner on a substrate. Blocking performance can be a consideration as the temperature which can result in unintended transfer of a fixed or fused image or parts thereof from a substrate carrying the image to another substrate.

Color printers commonly use four housings carrying different colors to generate full color images based on black plus the standard printing colors, cyan, magenta and yellow. In embodiments, additional housings may be desirable, including image generating devices possessing five housings, six housings or more, thereby providing the ability to carry additional toner colors to print an extended range of colors (extended gamut).

Thermoplastic and thermosetting polymers can be used for 3-D printing by any of a variety of materials and methods, such as, selective heat sintering, selective laser sintering, fused deposition modeling, robocasting and so on. A resin can be formed into sheets for use in laminated object manufacturing. In embodiments, a resin can be configured as a filament. Granular resin can be used in selective laser melting methods. Ink jet devices can deliver resin.

Examples of polymers include acrylonitrile butadiene styrene, polyethylene, polymethylmethacrylate, polystyrene and so on. In embodiments, polymers can be mixed with an adhesive to promote binding. In embodiments, an adhesive is interleaved with a layer of cured or hardened polymer to bind leafs or layers.

A polymer may be configured to contain a compound that on exposure to a stimulant decomposes and forms one or more free radicals, which promote polymerization of monomers of a polymer of interest, such as, forming branches, networks and covalent bonds. For example, a polymer can comprise a photoinitiator to induce curing on exposure to white light, an LED, UV light and so on. Such materials can be used in stereolithography, digital light processing, continuous liquid interface production and so on.

Waxes and other curing material can be incorporated into a 3-D composition or can be provided as a separate composition for deposition on a layer of a resin of interest or between layers of a resin of interest.

For example, a selective laser sintering powder, such as, a polyacrylate or polystyrene, is placed in a reservoir atop of a delivery piston. Granular resin is transferred from the reservoir to a second void comprising a fabrication piston which carries the transferred resin in the form of a thin layer. The thin layer is then exposed to a light or a laser tuned to melt and to fuse selected sites of the layer of resin particles. A second layer of resin granules is added from the reservoir to the fabrication void and the laser again melts and fuses selected portions of the layer of granules. The heating and fusion is of an intensity and strength to enable heating and fusing of sites from the second layer to sites of the first layer, thereby forming a growing solid structure in the vertical direction. In embodiments, an adhesive is applied to the fused first layer before the unfused granular resin for the second layer is applied. When completed, the unfused resin powder is removed leaving the fused granules in the form of a designed structure. Such a manufacturing method is an additive process as successive layers of the structure are laid down consecutively.

Toner herein can be can be used to manufacture articles, such as, sensors, materials with solvent switchable electronic properties, optical limiters and filters, and optical data storage devices. Plasmonic properties of metals enable bioimaging because, contrary to commonly used fluorescent dyes, nanoparticulate metal does not undergo photobleaching and can be used to monitor dynamic events over an extended period of time.

The following Examples illustrate embodiments of the disclosure. The Examples are illustrative only and are not intended to limit the scope of the present disclosure. Parts and percentages are by weight unless otherwise indicated.

EXAMPLES

Example 1: Reaction Products of Rosin Acid with Glycerine Carbonate

To a one liter Parr 4020 reactor equipped with a mechanical stirrer were added glycerine carbonate (130 g, 1.1 mole), tetraethyl ammonium iodide (1.285 g, 0.005 mole) and dehydroabietic acid (DHAA) (100.1 g, 0.33 mole). The mixture was heated to 150° C. under a nitrogen atmosphere and after two hours, additional DHAA (200.3 g, 0.67 mole) was added over a 2 hr period. The temperature was maintained at 150° C. for an additional 8 hours until an AV of <1.0 mg KOH/g was attained, which relates to >95% conversion of reagents into a polyester polymer.

Two grams of reaction products were subjected to high pressure liquid chromatographic (HPLC) separation using ethyl acetate (25%) and hexanes (75%) as eluent. Bis-rosin alcohols III and IV and carbonate V were separated and identified by proton nuclear magnetic resonance (NMR), $C^{13}$ NMR and mass spectroscopy. The mixture of rosin-diols I and II was complexed with copper (II) chloride, separated and regenerated with ammonia to rosin-diols I and II, respectively, and characterized by proton NMR, $C^{13}$ NMR and mass spectroscopy. The relative ratios of rosin adducts I through V were determined by HPLC. The HPLC was performed with a Synergi RP-Polar $C^{18}$ column using a mobile phase mixture of 20% water, 0.1% trifluoroacetic acid, 40% acetonitrile and 40% tetrahydrofuran with a flow rate of 1 ml/min, with a run time of 10 min and using a UV detector.

Examples 2-5: Reaction Products of Rosin Acid with Glycerine Carbonate

The method of Example 1 was practiced with reagent amounts and reaction conditions varied as provided in Table 1.

TABLE 1

| Ex-ample | Glycerine Carbonate (mole) | Temp. ° C. | Catalyst mol % | Rosin Adduct (% wt) I/II | III | IV | V | Ratio I/II/V:III/IV |
|---|---|---|---|---|---|---|---|---|
| 1 | 1.1 | 150 | 0.5 | 64 | 14 | 6 | 15 | 4:1 |
| 2 | 1.1 | 165 | 0.5 | 44 | 21 | 18 | 15 | 1.5:1 |
| 3 | 1.1 | 150 | 18 | 62 | 12 | 5 | 13 | 4.2:1 |
| 4 | 1.1 | 165 | 18 | 56 | 12 | 8 | 9 | 3.2:1 |
| 5 | 3.0 | 160 | 0.5 | 85 | 1 | 4 | 10 | 19:1 |

Example 6: Synthesis of Bio-Based Resin with 8 Mol % of Rosin

To a 2 Liter Buchi reactor were added 220 g of hydrogenated rosin acid (8 mol %), 90 g glycerin carbonate GC) and 3 g of tetraethyl ammonium bromide (TAB). The mixture was heated to 170° C. and maintained for 16 hours until the AV was less than 1 mg/g KOH. To that mixture in the same reactor were added 118.92 g of 1,4-butanediol (BD), 185.7 g of propylene glycol (PG), 528.96 g of isophthalic acid (IPA), 15.66 g of succinic acid (SA) and 3 g of FASCAT 4100. The mixture then was heated to 220° C. over a 6 hr period and maintained overnight. Thereafter, the mixture was held under vacuum at 225° C. until the desired $T_g$ was obtained, 122.7° C., and the resin had an AV of 10.27 mg/g KOH.

Example 7: Synthesis of Bio-Based Resin with 6 Mol % of Rosin

To a 2 Liter Buchi reactor were added 150 g of hydrogenated rosin acid, 70 g GC and 3 g of TAB. The mixture was heated to 170° C. and maintained for 16 hours until the AV was less than 1 mg/g KOH. To that mixture in the same reactor were added 118.92 g of BD, 185.7 g of PG, 528.96 g of IPA, 15.66 g of SA and 3 g of FASCAT 4100. The mixture then was heated to 220° C. over a 6 hour period and maintained overnight. Thereafter, the mixture was held under vacuum at 225° C. until the desired $T_g$ was obtained, 122.7° C., and the resin had an AV of 10.27 mg/g KOH.

Example 8: Toner with 8 Mol % Rosin Resin and C10:C9 CPE

Into a 2 liter glass reactor equipped with an overhead mixer were added 290.82 g of the resin from Example 6, 26.46 g of C10:C9 CPE resin emulsion (31.46 wt %), 36.50 g of IGI wax dispersion (30.33 wt %) and 43.36 g cyan pigment, PB15:3 (16.59 wt %). Then, 2.15 g of $Al_2(SO_4)_3$ (27.85 wt %) were added under homogenization. The mixture was heated to 38.9° C. to aggregate the particles while stirring at 300 rpm. Particle size was monitored with a COULTER COUNTER until the particles reached a volume average particle size of 5.54 μm, $GSD_v$ of 1.18. Thereafter, the pH of the reaction slurry was increased to 8.3 using 4 wt % NaOH solution followed by 4.62 g EDTA (39 wt %) to freeze toner growth. After freezing, the reaction mixture was heated to 76.5° C. for 3 hours resulting in a final particle size of 5.42 μm, $GSD_v$ of 1.21, $GSD_n$ of 1.23 and circularity of 0.972. The toner slurry then was cooled to RT, separated by sieving (25 μm), filtered, washed and freeze dried.

Example 9: Toner with 8 Mol % Rosin Resin and C10:C6 CPE

The process of Example 8 was repeated except 24.08 g of C10:6 CPE emulsion (34.56 wt %) were used instead of the C10:9 resin emulsion.

The resulting toner had an average particle size of 5.90 μm, $GSD_v$ of 1.24, $GSD_n$ of 1.23 and circularity of 0.969.

Example 10: Toner with 6 Mol % Rosin Resin and C10:6 CPE

The process of Example 9 was repeated except the bioresin of Example 7 comprised of 6 mol % of rosin was used.

The resulting toner had an average particle size of 5.83 μm, $GSD_v$ of 1.23, $GSD_u$ of 1.23 and circularity of 0.971.

Example 11: Toner Analysis

The toners were analyzed for various properties. Two cyan toners were used as controls. Control Toner 1 is comprised of a polystyrene-acrylate resin and does not contain a CPE resin. Control Toner 2 is comprised of a non-biobased amorphous polyester resin and CPE C10:C9.

The structural properties of the five toners were similar, Table 2.

TABLE 2

| Toner Properties | Control 1 | Control 2 | Example 8 | Example 9 | Example 10 |
|---|---|---|---|---|---|
| Rosin-Resin | — | — | 8% | 8% | 6% |
| CPE | — | 6.8% (10:9) | 6.8% (10:9) | 6.8% (10:6) | 6.8% (10:6) |
| Wax | 9% | 9% | 9% | 9% | 9% |
| Size (μm) | 5.90 | 5.8 | 5.42 | 5.90 | 5.83 |
| GSD (v/n) | 1.21/1.21 | 1.22/1.21 | 1.21/1.23 | 1.23/1.23 | 1.23/1/23 |
| Circ | 0.968 | 0.969 | 0.972 | 0.969 | 0.971 |

Fusing parameters, such as, MFT (minimum fixing temperature) and hot offset, of the above prepared toners were collected with samples of the particles fused onto Color Xpressions Select (90 gms) paper using a fusing fixture similar to that of the commercial Xerox 700) printer. Fixing latitude is the difference of hot offset and MFT, that is, MFT subtracted from hot offset temperature.

TABLE 3

| Fusing and Blocking Properties of Toners | Control 1 | Control 2 | Example 8 | Example 9 | Example 10 |
|---|---|---|---|---|---|
| Gloss at MFT | 19.7 | 31.8 | 27.3 | 10.1 | 9.9 |
| Hot Offset (° C.) | >210 | 200 | >210 | >210 | >210 |
| MFT (° C.) | 139 | 125 | 125 | 120 | 125 |
| Latitude (° C.) | >71 | 75 | >85 | >90 | >85 |
| Blocking (° C.) | 53 | 54 | 54 | 49 | 54 |

Control toner 1 has a high MFT of 139° C. and good blocking, whereas control toner 2 with the more expensive CPE C10:9 has a lower MFT of 125° C. and good blocking. Thus, CPE lowers MFT. The toner of Example 8 with a biobased resin with 8 mol % rosin and the more expensive CPE C10:9, also resulted in a lower MFT of 125° C. and good blocking, demonstrating that a bioresin can be used in toner and higher amounts of rosin in a resin can be used with larger CPE's. The toner of Example 9 with biobased resin comprising 8 mol % rosin and the lower cost CPE C10:6 also resulted in a lower MFT of 120° C., but had poor blocking of 49° C. On the other hand, the toner of Example 10 with biobased resin comprising 6 mol % rosin and the lower cost CPE C10:6 resulted in both a low MFT of 125° C. and good blocking of 54° C. Therefore, unexpectedly, a lower cost toner with good blocking and low fixing temperature made from sustainable materials was obtained with a particular amount of the rosin component in a resin and lower cost, smaller, crystalline polyester resins.

It will be appreciated that various of the above-disclosed and other features and functions, or alternatives thereof, may be combined into other different systems or applications. Changes, modifications and the like can be made to the teachings herein without departing from the spirit and scope of the subject matter of interest. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

All references cited herein are incorporated herein by reference in entirety.

We claim:

1. A toner comprising a bio-based polyester resin comprising a mixture of a rosin-diol, a bis-rosin alcohol and a rosin-carbonate, wherein said mixture is present in the bio-based polyester resin in an amount of greater than 0 mole % to no more than 6 mole %; a crystalline polyester (CPE) resin, wherein said CPE is comprised of an acid monomer comprising at least one methylene group and an alcohol monomer comprising at least one methylene group, wherein said acid and alcohol monomers together comprise 16 or fewer methylene groups; an optional colorant; an optional wax; and optionally, a resin monomer comprising bisphenol A (BPA), wherein said toner comprises 0% BPA.

2. The toner of claim 1, wherein said mixture comprises some or all rosin adducts I-V:

I

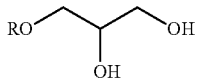

II

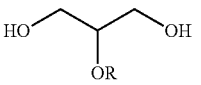

III

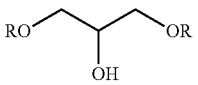

IV

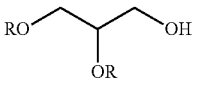

-continued

V

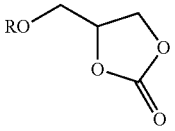

wherein R is a rosin moiety.

3. The toner of claim 1, wherein said CPE comprises a C10:C6 resin.

4. The toner of claim 1, wherein one ester unit obtained from an alcohol monomer and an acid monomer of said CPE is represented by the structure;

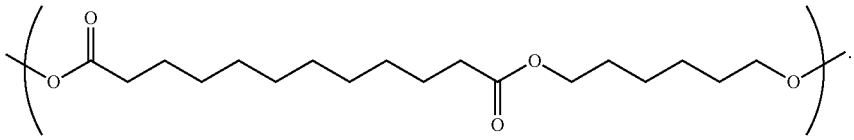

5. The toner of claim 1, wherein said mixture is present in the bio-based polyester resin in an amount of greater than 5 mole % to no more than 6 mole %.

6. The toner of claim 1, wherein said CPE comprises dodecanedioic acid.

7. The toner of claim 1, wherein said CPE comprises hexanediol.

8. The toner of claim 1, wherein said bio-based polyester resin further comprises a polyacid, a polyol or both.

9. The toner of claim 1, wherein said bio-based polyester resin further comprises fumaric acid, succinic acid, terephthalic acid or isophthalic acid.

10. The toner of claim 1, wherein said bio-based polyester resin comprises 1,2-ethanediol, 1,2-propanediol, 1,3-propanediol, 1,4-butanediol or cyclohexanediol.

11. The toner of claim 1, comprising a fixing temperature of no more than about 125° C.

12. The toner of claim 1, comprising a blocking temperature of at least about 53° C.

13. The toner of claim 1, comprising a fixing latitude of at least about 80° C.

14. The toner of claim 1, wherein said resin comprises a polydispersity of at least about 5.

15. The toner of claim 1, comprising a shell.

16. The toner of claim 1, further comprising an amorphous resin.

17. The toner of claim 1, further comprising a colorant, a wax or both.

18. A developer comprising the toner of claim 1.

19. The developer of claim 18, comprising a carrier.

20. The developer of claim 19, wherein said carrier comprises a coating.

* * * * *